US010525300B1

(12) United States Patent
Boatwright

(10) Patent No.: US 10,525,300 B1
(45) Date of Patent: Jan. 7, 2020

(54) MULTIPURPOSE EXERCISE STAND FOR COMPOUND FITNESS TRAINING

(76) Inventor: Donald Jeffrey Boatwright, Charlotte, NC (US)

( * ) Notice: Subject to any disclaimer, the term of this patent is extended or adjusted under 35 U.S.C. 154(b) by 901 days.

(21) Appl. No.: 13/493,234

(22) Filed: Jun. 11, 2012

(51) Int. Cl.
*A63B 21/068* (2006.01)
*A63B 23/12* (2006.01)

(52) U.S. Cl.
CPC ..... *A63B 21/068* (2013.01); *A63B 23/1218* (2013.01); *A63B 23/1227* (2013.01)

(58) Field of Classification Search
CPC ..... A63B 21/068; A63B 23/1218; A63B 23/1227
USPC ..... 482/142
See application file for complete search history.

(56) References Cited

U.S. PATENT DOCUMENTS 4,815,727 A * 3/1989 Kiribuchi ..... A63B 9/00 182/178.1
5,024,601 A * 6/1991 Barker ..... 434/255
5,236,333 A * 8/1993 Barba, Jr. ..... 601/34
5,395,296 A * 3/1995 Webster et al. ..... 482/130
5,928,119 A * 7/1999 Dinkel ..... 482/141
7,537,552 B2 * 5/2009 Dalebout ..... A63B 21/00072 482/121
7,651,449 B1 * 1/2010 Balentine ..... A63B 21/00047 248/163.1
2005/0070406 A1 * 3/2005 Delp ..... 482/91
2005/0187086 A1 * 8/2005 Bull ..... A63B 23/03541 482/142
2006/0211552 A1 * 9/2006 Williams ..... 482/139
2012/0046150 A1 * 2/2012 Stacey ..... A63B 1/00 482/131

OTHER PUBLICATIONS http://www.pvcplans.com/scuba.htm, earliest known publication date Feb. 11, 2009, last visited Feb. 28, 2017.*

* cited by examiner

*Primary Examiner* — Nyca T Nguyen
(74) *Attorney, Agent, or Firm* — Schwartz Law Firm, P.C.

(57) ABSTRACT

A multipurpose exercise stand for compound fitness training includes a push-training bar assembly, and a base assembly adapted for locating the push-training bar assembly above a supporting surface. The push-training bar assembly includes first and second sets of parallel inside and outside dip grip segments. The first and second sets are sufficiently spaced apart to accommodate body lifting and body lowering movement of a user performing a dip exercise while gripping either of the two inside dip grip segments or the two outside dip grip segments.

8 Claims, 20 Drawing Sheets

MULTIPURPOSE EXERCISE STAND FOR COMPOUND FITNESS TRAINING

TECHNICAL FIELD AND BACKGROUND OF THE INVENTION

This invention relates broadly and generally to a multipurpose exercise stand for compound fitness training.

Many weight training exercises can be categorized into two types, pushing movements and pulling movements. Pushing exercises are compound movements, which simultaneously extend the elbow and shoulder joints. Pulling movements involve flexion of the elbows and retraction of the upper back muscles. These movements are crucial to muscular symmetry and functional balance. Typical "push-training" involves exercising the chest, shoulders, and triceps; whereas "pull-training" exercises primarily the back, biceps, and traps. Other weight training exercises involve angular movements. Unlike compound push and pull exercises, angular movements do not follow a straight line, and are generally considered isolation exercises—isolated because they do involve the movement of just a single joint.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a multipurpose exercise stand for compound fitness training. The exercise stand comprises a horizontal push-training bar assembly, and a vertical base assembly adapted for locating the push-training bar assembly above a supporting surface. The push-training bar assembly comprises first and second sets of parallel inside and outside dip grip segments. The first and second sets are sufficiently spaced apart (e.g., 18 to 36 inches) to accommodate body lifting and body lowering movement of a user performing a dip exercise while gripping either of the two inside dip grip segments or the two outside dip grip segments. In variations of the dip exercise, the user may grip one inside dip grip segment and one outside dip grip segment. In alternative embodiments, each of first and second sets may include 3 or more parallel dip grip segments for added variation.

According to another exemplary embodiment, the push-training bar assembly is generally U-shaped.

According to another exemplary embodiment, the push-training bar assembly further comprises a crossbar segment interconnecting and perpendicularly disposed to the first and second sets of inside and outside dip grip segments.

According to another exemplary embodiment, the push-training bar assembly comprises an arrangement of rigid polymer pipes and pipe fittings.

According to another exemplary embodiment, the base assembly comprises a plurality of longitudinal rigid spacer bars perpendicularly disposed to the push-training bar assembly.

In another exemplary embodiment, the present disclosure comprises a multipurpose exercise stand for compound fitness training. The exercise stand includes a horizontal push-training bar assembly, a horizontal pull-training bar assembly, and a plurality of longitudinal rigid spacer bars interconnecting the push-training bar assembly and the pull-training bar assembly. The push-training bar assembly comprises first and second pairs of parallel inside and outside dip grip segments, and a crossbar segment interconnecting and perpendicularly disposed to the first and second pairs. The first and second pairs are sufficiently spaced apart (e.g., 18 to 36 inches) to accommodate body lifting and body lowering movement of a user performing a dip exercise while gripping either of the two inside dip grip segments or the two outside dip grip segments.

According to another exemplary embodiment, the pull-training bar assembly comprises first and second pairs of inside and outside pull bar segments longitudinally aligned with the first and second pairs of inside and outside dip grip segments.

According to another exemplary embodiment, the pull-training bar assembly further comprises a first crossbar segment interconnecting and perpendicularly disposed to the first and second pairs of inside and outside pull bar segments, and longitudinally aligned with the crossbar segment of the push-training bar assembly.

According to another exemplary embodiment, the pull-training bar assembly further comprises an intermediate second crossbar segment connected and perpendicularly disposed to the inside pull bar segments.

According to another exemplary embodiment, the pull-training bar assembly further comprises a short center bar segment connected and perpendicularly disposed to the intermediate second crossbar segment and a third crossbar segment.

According to another exemplary embodiment, the pull-training bar assembly comprises an arrangement of rigid polymer pipes and pipe fittings.

According to another exemplary embodiment, the longitudinal spacer bars comprise rigid polymer pipes.

According to another exemplary embodiment, the longitudinal spacer bars are perpendicularly disposed between the push-training bar assembly and the pull-training bar assembly.

According to another exemplary embodiment, an independent rigid grip handle is provided for use in combination with the stand to perform compound pull exercises.

According to another exemplary embodiment, the grip handle comprises first and second spaced apart hand bars integrally joined together by at least one generally V-shaped connector. The term "generally V-shaped" is broadly defined herein to include a shape having a substantially arcuate center bend. In one embodiment, the arcuate center bend has a radius in the range of 0.5 to 1.5 inches. In another embodiment, the arcuate center bend has a radius of approximately 1.0 inches.

According to another exemplary embodiment, the first hand bar of the grip handle is angled relative to said second hand bar. In alternative embodiments, the exemplary grip handle resembles a more conventional double D handle.

According to another exemplary embodiment, segments of the push-training bar assembly and the pull-training bar assembly are color coded for different exercises.

In yet another exemplary embodiment, the present disclosure comprises a multipurpose exercise stand for compound fitness training. The exercise stand includes a horizontal generally U-shaped push-training bar assembly, a horizontal four-sided pull-training bar assembly longitudinally spaced from the push-training bar assembly, and a plurality of longitudinal rigid spacer bars interconnecting and perpendicularly disposed to the push-training bar assembly and the pull-training bar assembly. The push-training bar assembly comprises first and second pairs of parallel inside and outside dip grip segments, and a crossbar segment interconnecting and perpendicularly disposed to the first and second pairs of dip grip segments. The first and second pairs are sufficiently spaced apart (e.g., 18 to 36 inches) to accommodate body lifting and body lowering movement of a user performing a dip exercise while gripping either of the two inside dip grip segments or the two outside dip grip segments.

The exemplary multipurpose exercise stand described herein may be compact, lightweight, stand-alone, self-supporting, portable, and readily disassembled and reassembled. One or both of the push-training bar assembly and the pull-training bar assembly may be assembled in multiple segments and fittings, as illustrated in the drawings, or may be integrally molded together as a single homogenous unit. The exemplary exercise stand is a both-ends-up (or both-ends-usable) fitness device that may be used for both push and pull-training exercises together with various accessory handles, straps, cables, bands, and the like.

The terms "horizontal" and "vertical" are used herein with reference to a typical upright orientation of the exemplary exercise stand. In this upright orientation, the spaced push-training and pull-training bar assemblies are generally horizontally disposed. For other training movements, the exemplary stand may be oriented on its side as shown in FIG. 24. In this orientation, the longitudinal spacer bars are horizontally disposed relative to the now vertically arranged push-training and pull-training bar assemblies.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

Figure 1:
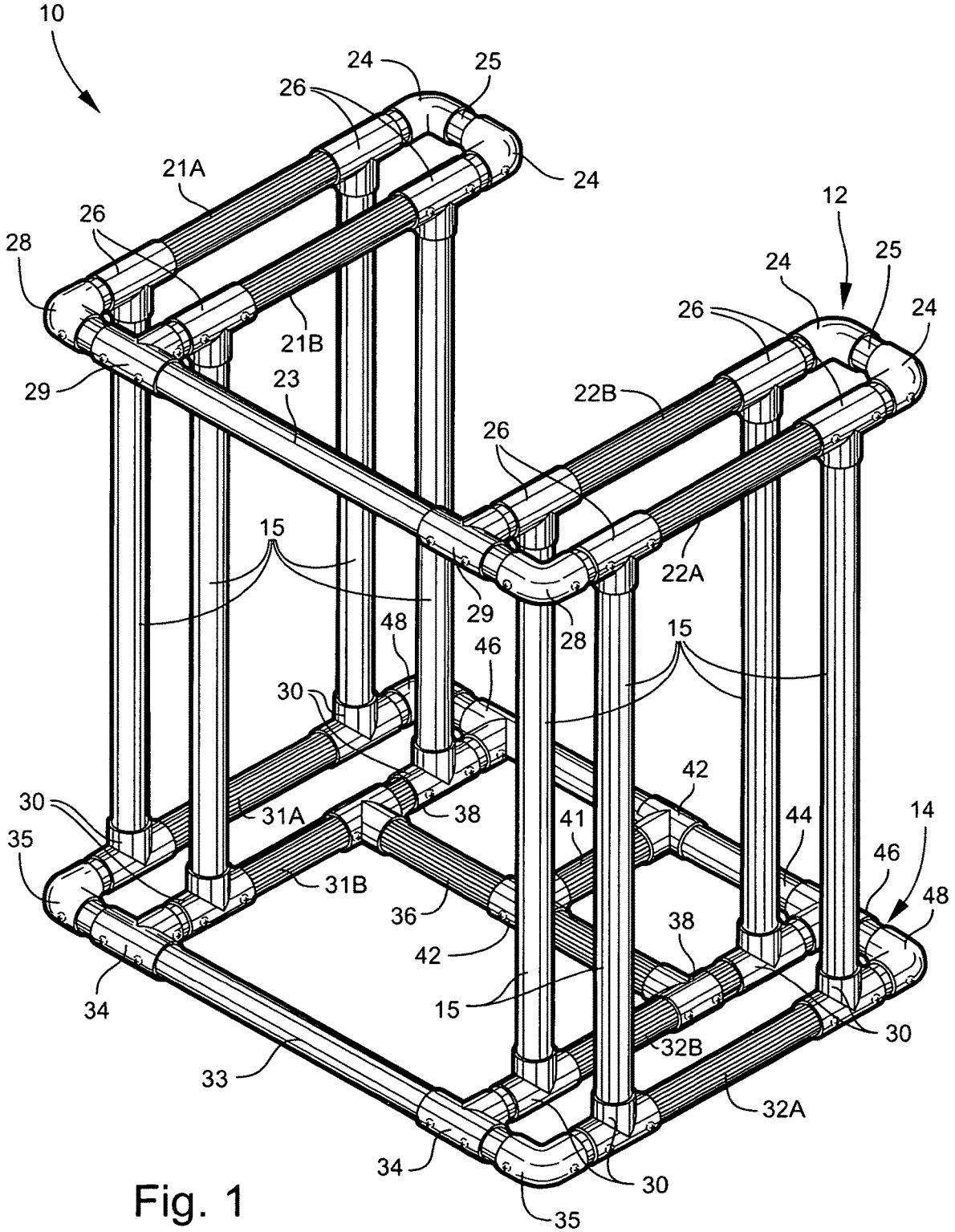
FIG. 1 is a perspective view of a multipurpose exercise stand according to one exemplary embodiment of the present disclosure.
Figure 2:
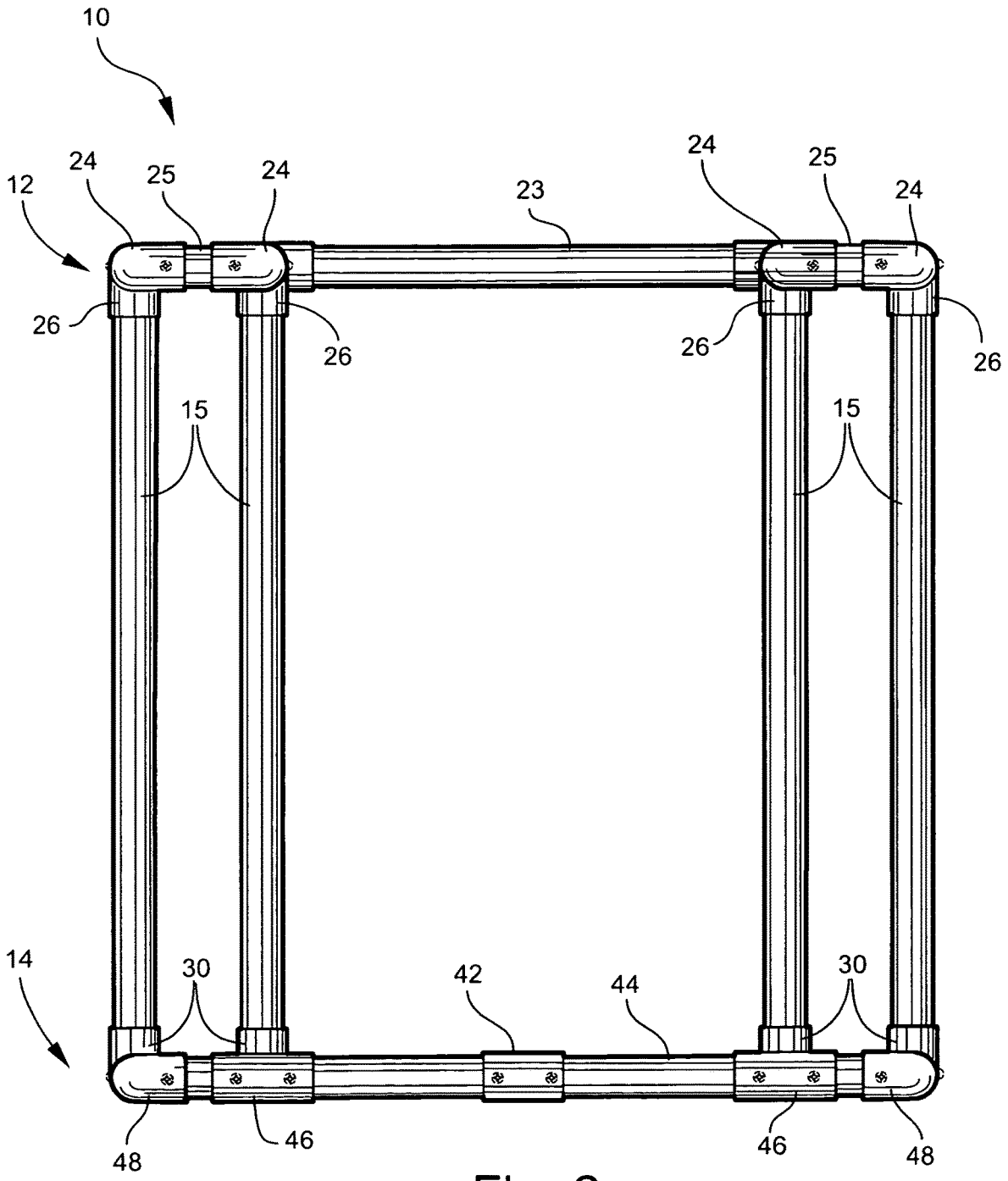
FIG. 2 is a rear view of the exemplary exercise stand.
Figure 3:
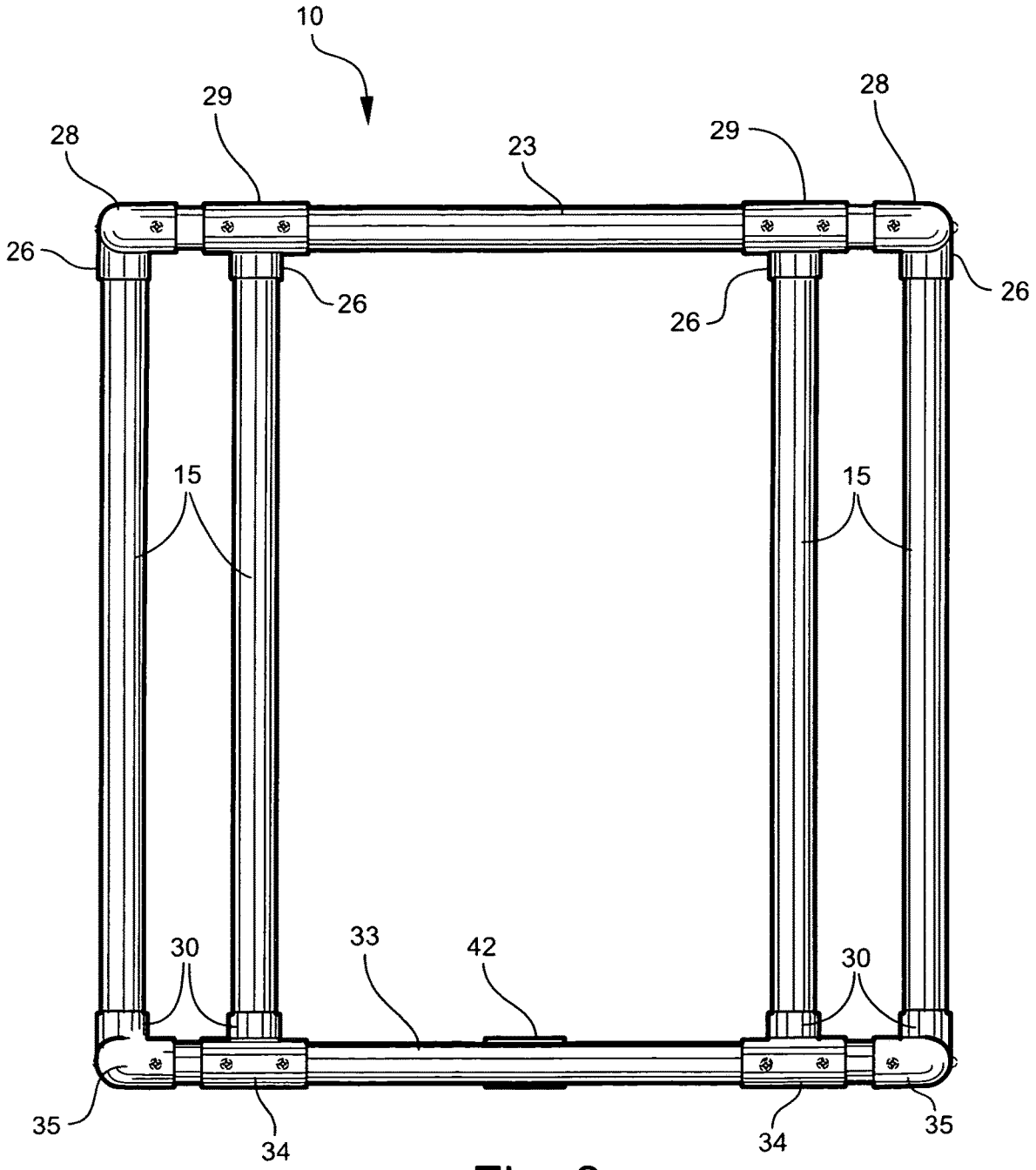
FIG. 3 is a front view of the exemplary exercise stand.
Figure 4:
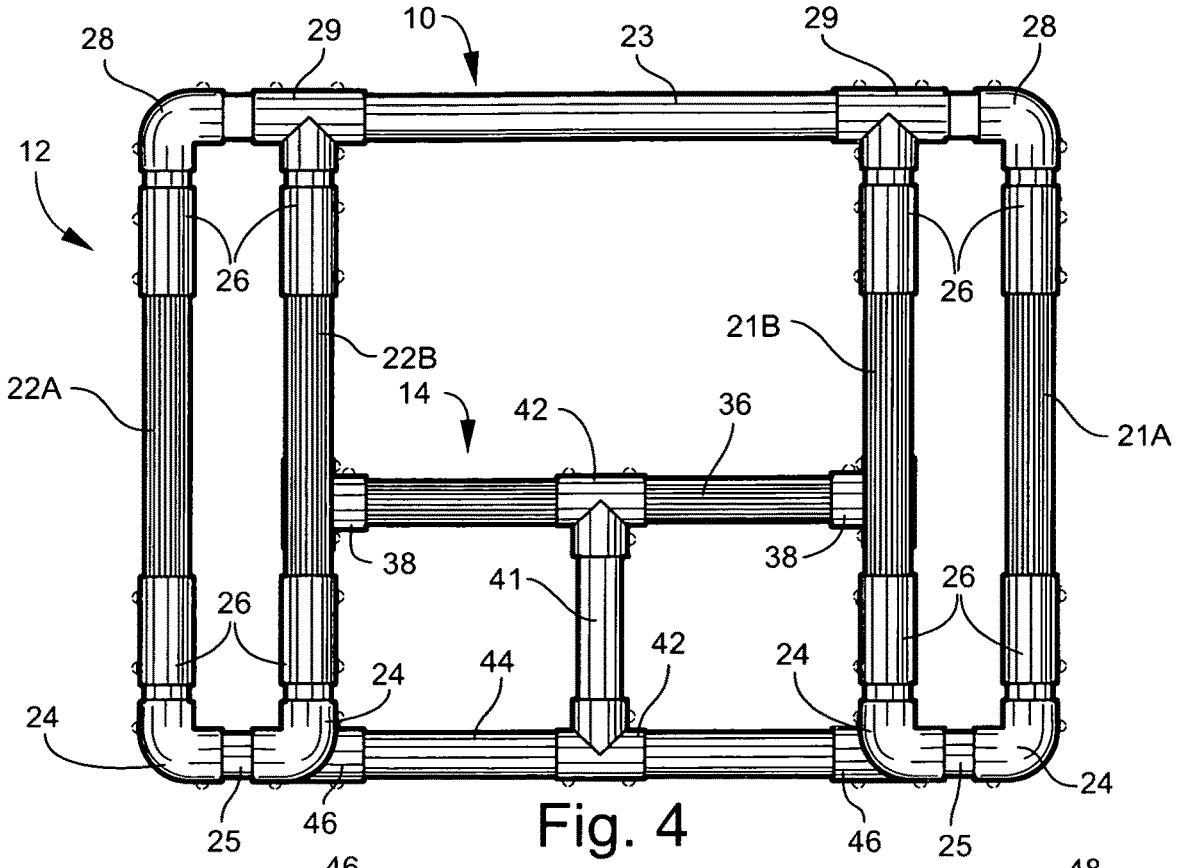
FIG. 4 is a top view of the exemplary exercise stand.
Figure 5:
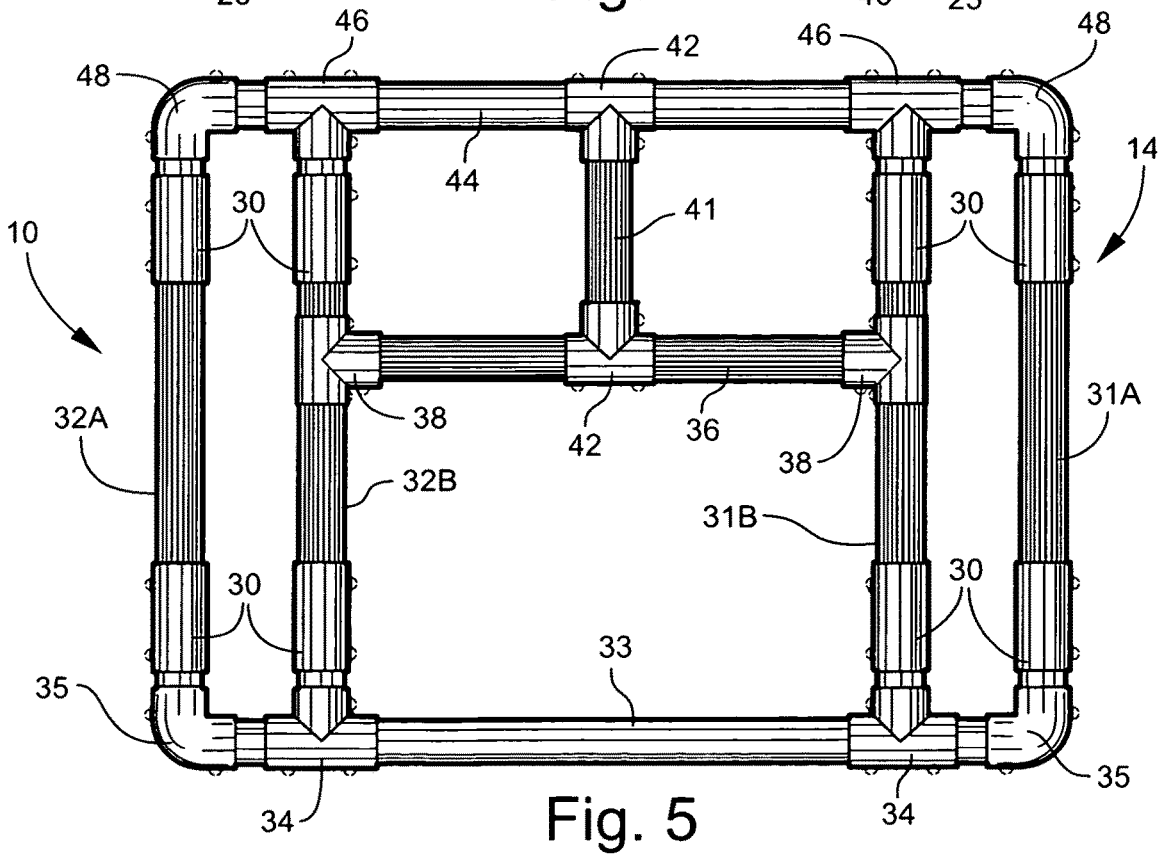
FIG. 5 is a bottom view of the exemplary exercise stand.
Figure 6:
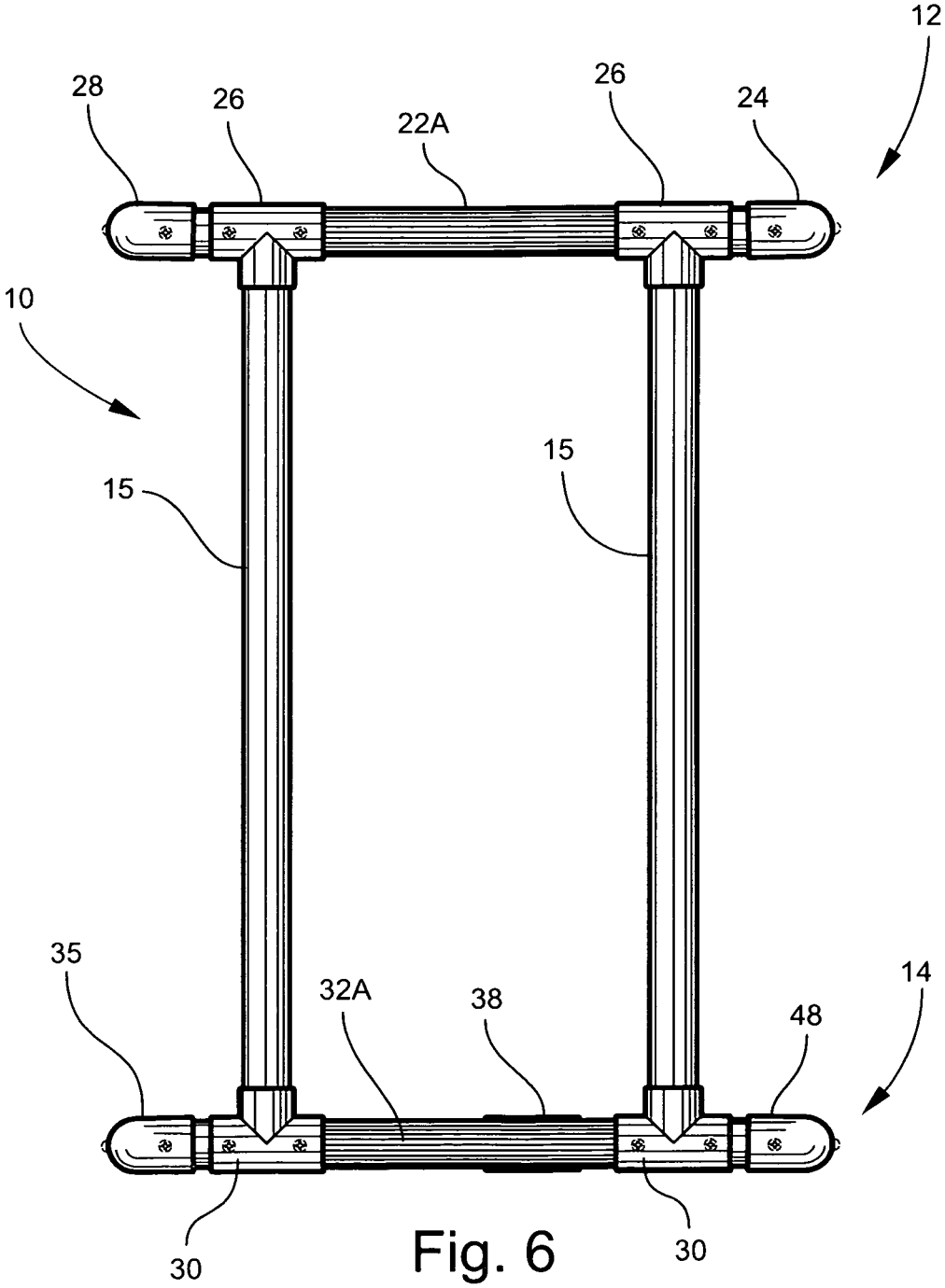
FIG. 6 is a left side view of the exemplary exercise stand.
Figure 7:
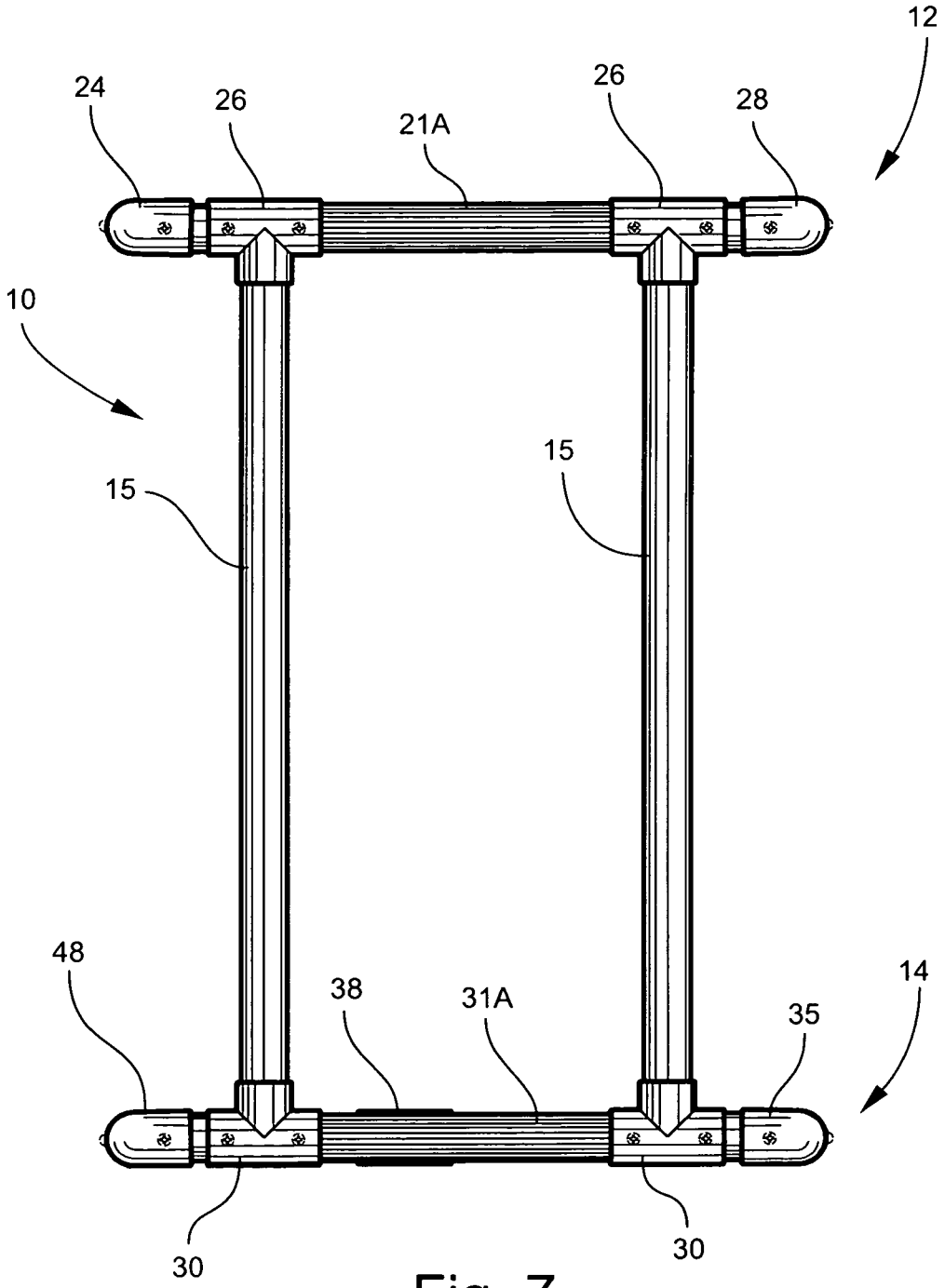
FIG. 7 is a right side view of the exemplary exercise stand.

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise.

Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now specifically to the drawings, a multipurpose exercise stand according to one exemplary embodiment of the present disclosure is illustrated in FIGS. 1-7, and shown generally at broad reference numeral 10. The exemplary exercise stand 10 is a "both-ends-up" (or "both-ends-usable") stand-alone device applicable for both compound push and pull fitness training. In the embodiment shown, the exercise stand 10 is constructed of interlinked, rigid, hollow polymer (e.g., PVC) pipes and pipe fittings. The exemplary stand 10 may alternatively be fabricated, in whole or in part, of any other desired material including (e.g) fiberglass. The pipes and pipe fittings may be removably attached together by conventional fasteners, such as screws or rivets, or may be permanently attached using an adhesive or other bonding agent, welding, or the like. Some or all of the pipes may be fluted for enhanced strength and grip-ability.

Figure 10:
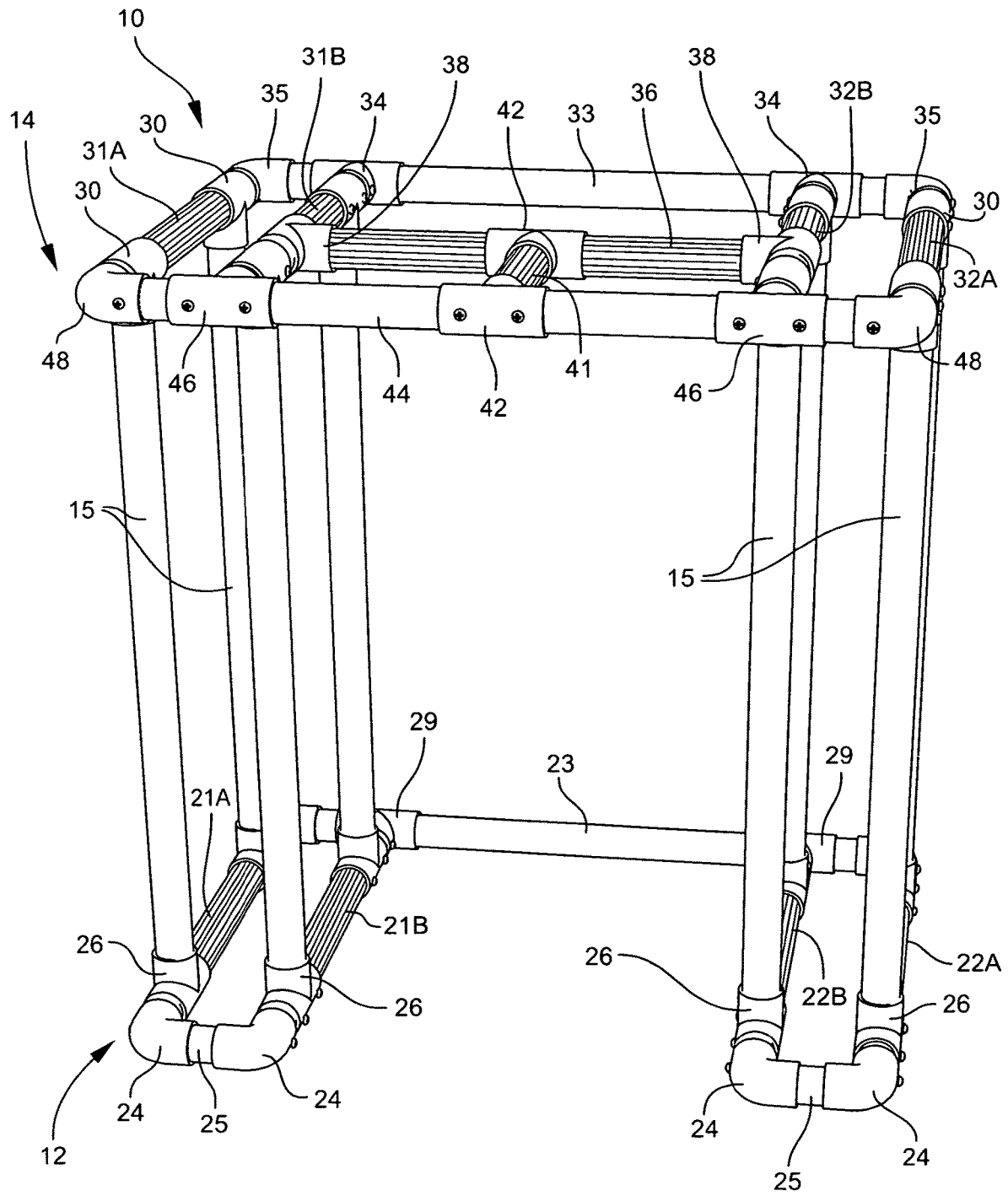
FIG. 10 is a perspective view of the exemplary exercise stand oriented such that the pull-exercise bar assembly is elevated above the supporting floor.

Referring to FIGS. 1-7, the exemplary exercise stand 10 comprises a horizontal generally U-shaped push-training bar assembly 12, a horizontal four-sided pull-training bar assembly 14 vertically spaced from the push-training bar assembly 12, and a number of rigid vertical spacer bars 15 interconnecting and perpendicularly disposed to the push-training bar assembly 12 and the pull-training bar assembly 14. The vertical spacer bars 15 and pull-training bar assembly 14 collectively form a base assembly for the elevated push-training bar assembly 12 in the stand orientation of FIG. 1. In an alternative orientation shown (e.g.) in FIG. 10, the vertical spacer bars 15 and push-training bar assembly 12 collectively form a base assembly for the elevated pull-training bar assembly 14.

The push-training bar assembly 12 includes first and second horizontal pairs of parallel outside and inside dip grip segments 21A, 22A and 21B, 22B, and a horizontal crossbar segment 23 interconnecting and perpendicularly disposed to the pairs of dip grip segments 21A, 22A, 21B, 22B. The dip grip segments 21A, 22A, 21B, 22B of each pair are connected together at their distal ends by respective elbow fittings 24 and end connectors 25, and are connected to the vertical spacer bars 15 by respective T-fittings 26. The proximal ends of the dip grip segments 21A, 22A, 21B, 22B are connected to the horizontal crossbar segment 23 by elbow fittings 28 and T-fittings 29. The inside dip grip segments 21B, 22B are sufficiently spaced apart (e.g., 18 to 36 inches) to accommodate body lifting and body lowering movement of a user performing a dip exercise between the pairs while gripping either of the two inside dip grip segments 21B, 22B or the two outside dip grip segments 21A, 22A. See FIGS. 8 and 9, respectively. In this embodiment, each of the outside and inside dip grip segments 21A, 22A, 21B, 22B are fluted. The space between adjacent grip segments 21A, 21B and 22A, 22B may be in the range of 2-6 inches.

The horizontal pull-training bar assembly 14 is connected to the vertical spacer bars 15 by T-fittings 30, and comprises first and second pairs of inside and outside pull bar segments 31A, 32A, 31B, 32B. The first and second pairs of pull bar segments 31A, 32A, 31B, 32B are longitudinally aligned with the first and second pairs of inside and outside dip grip segments 21A, 22A, 21B, 22B. The exemplary bar assembly 14 further comprises a first horizontal crossbar segment 33 interconnecting and perpendicularly disposed to the first and second pairs of inside and outside pull bar segments 31A, 32A, 31B, 32B, and longitudinally aligned with the horizontal crossbar segment 23 of the push-training bar assembly 12. T-fittings 34 and elbow fittings 35 connect the first crossbar segment 33 to the pairs of inside and outside pull bar segments 31A, 32A, 31B, 32B. An intermediate second crossbar segment 36 is connected and perpendicularly disposed to the inside pull bar segments 31B, 32B. T-fittings 38 connect opposite ends of the crossbar segment 36 to the inside pull bar segments 31B, 32B. A short center bar segment 41 is connected to the bar assembly 14 by T-fittings 42, and is perpendicularly disposed to the intermediate second crossbar segment 36 and a horizontal third crossbar segment 44. The third crossbar segment 44 is perpendicularly disposed to the spaced pairs of inside and outside pull bar segments 31A, 32A, 31B, 32B, and is connected to bar assembly 14 by T-fittings 46 and elbow fittings 48. In the embodiment shown, the pairs of inside and outside pull bar segments 31A, 32A, 31B, 32B, intermediate crossbar segment 36, and short center bar segment 41 are all fluted.

Exemplary Push-Training Exercises

Figure 8:
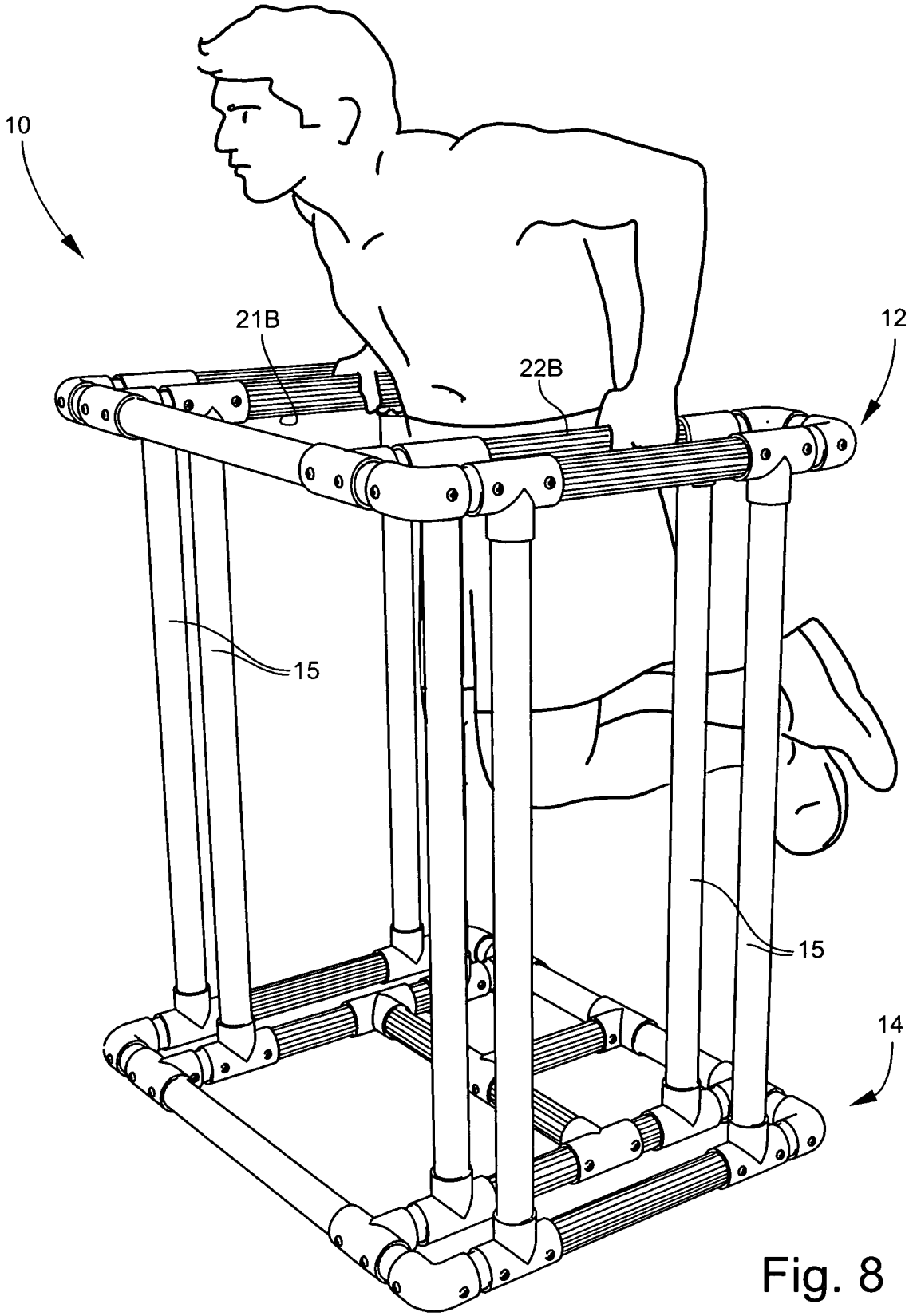
FIG. 8 is a perspective view of the exemplary exercise stand, and showing a user performing a body-weight push exercise.
Figure 9:
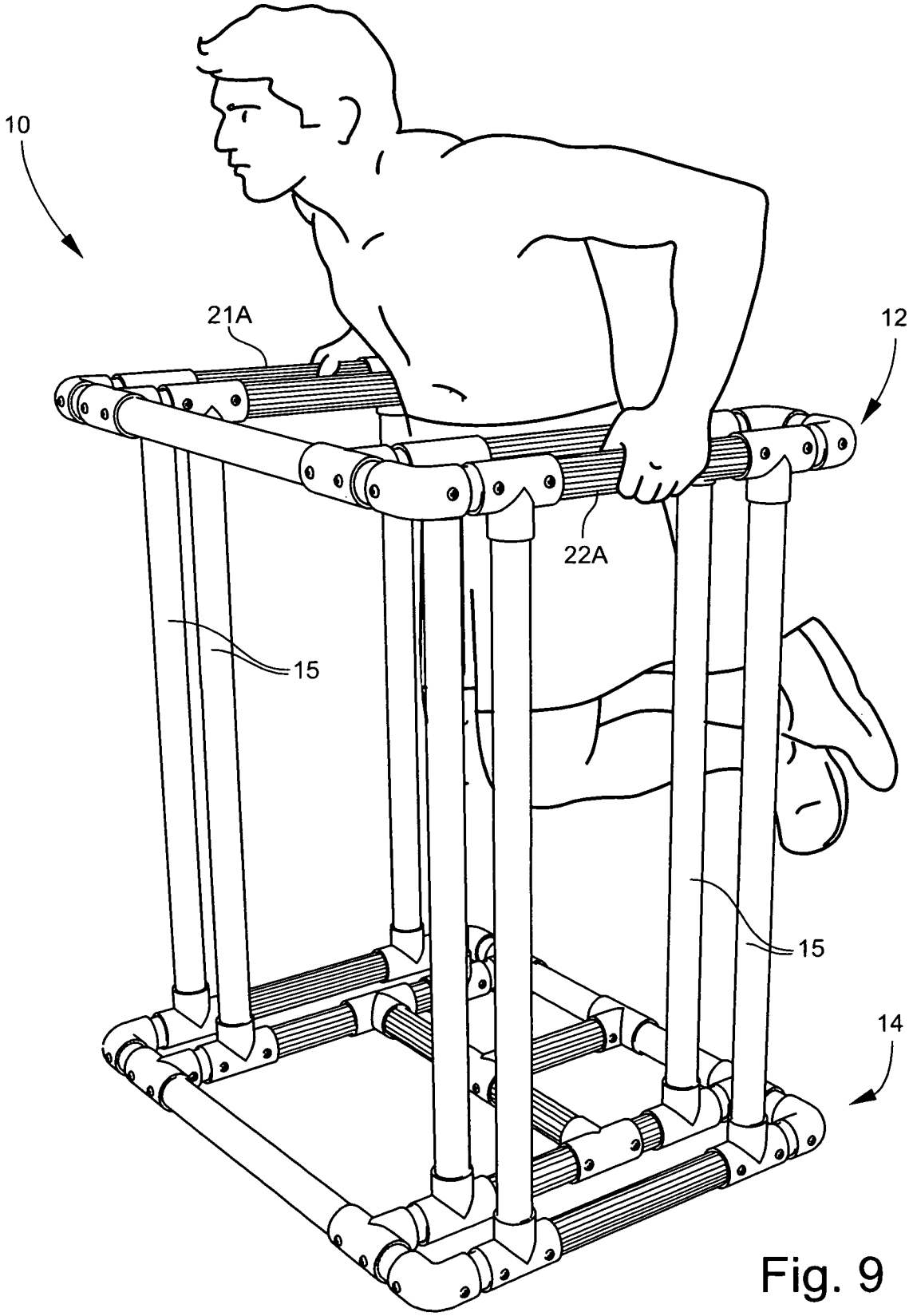
FIG. 9 is a perspective view of the exemplary exercise stand, and showing a user performing a second body-weight push exercise

FIGS. 8 and 9 illustrate respective dip (push movement) exercises using the push-training bar assembly 12 of the exemplary stand 10. In this orientation, the pull-training bar assembly 14 and vertical spacers 15 cooperate to form a base assembly for elevating the push-training bar assembly 12 above the supporting floor. For the first exercise shown in FIG. 8, the user grasps the two fluted inside dip bar segments 21B, 22B with palms facing in, and extends his arms and lifts his feet off the floor. From this elevated position while supporting his body weight, the user allows the torso to tilt forward slightly while lowering his body between the spaced dip bar segments 21B, 22B. The lowering movement stops when the shoulders are substantially level with the backwardly-pointed elbows. The user then pushes slowly upwardly returning to the original starting position and maintaining a slight bend in the elbow. Multiple repetitions may be performed in a single exercise set. While the dip exercise works primarily the chest, shoulder, and tricep muscles, greater emphasis is generally placed on the triceps when using the more closely spaced inside dip bar segments 21B, 22B. The two fluted inside dip bar segments 21B, 22B may be identically colored (e.g., red, blue, green, etc.—a color distinct from the remaining bar segments of the exercise stand 10) to indicate proper hand placement for this exercise.

The second dip exercise shown in FIG. 9 is performed in the exact manner described above, except that the user grasps the fluted outside dip bar segments 21A, 22A. This dip exercise also works primarily the chest, shoulder, and tricep muscles, although greater emphasis is generally placed on the shoulders and chest when using the farther spaced outside dip bar segments 21A, 22A. The two fluted outside dip bar segments 21A, 22A may also be identically colored (e.g., red, blue, green, etc.—a color distinct from the remaining bar segments of the exercise stand 10) to indicate proper hand placement for this particular exercise.

Exemplary Pull-Training Exercises

Figure 11:
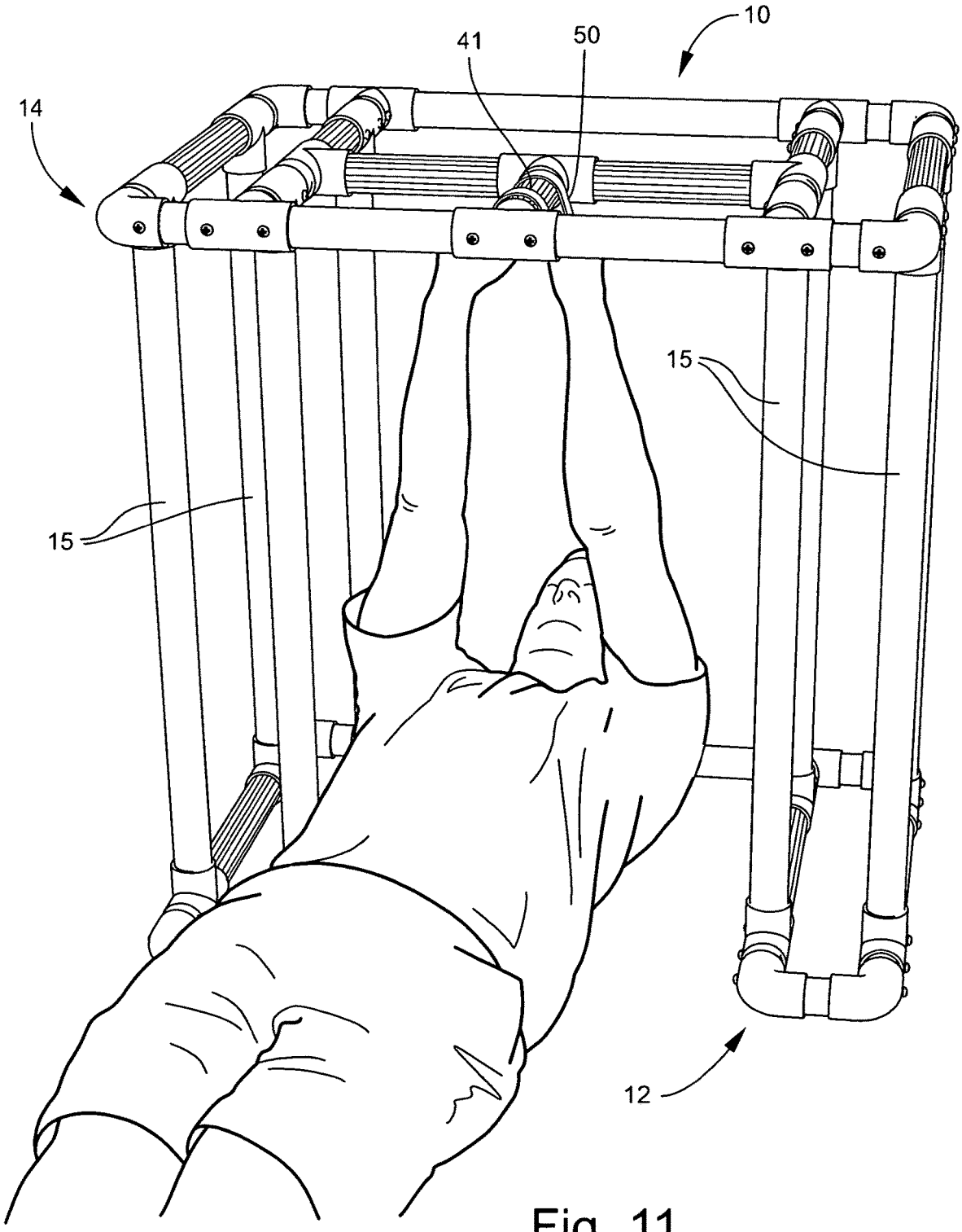
FIGS. 11, 12, 13, and 14 show a user demonstrating various pull movement exercises using the exemplary stand and an independent grip handle.
Figure 12:
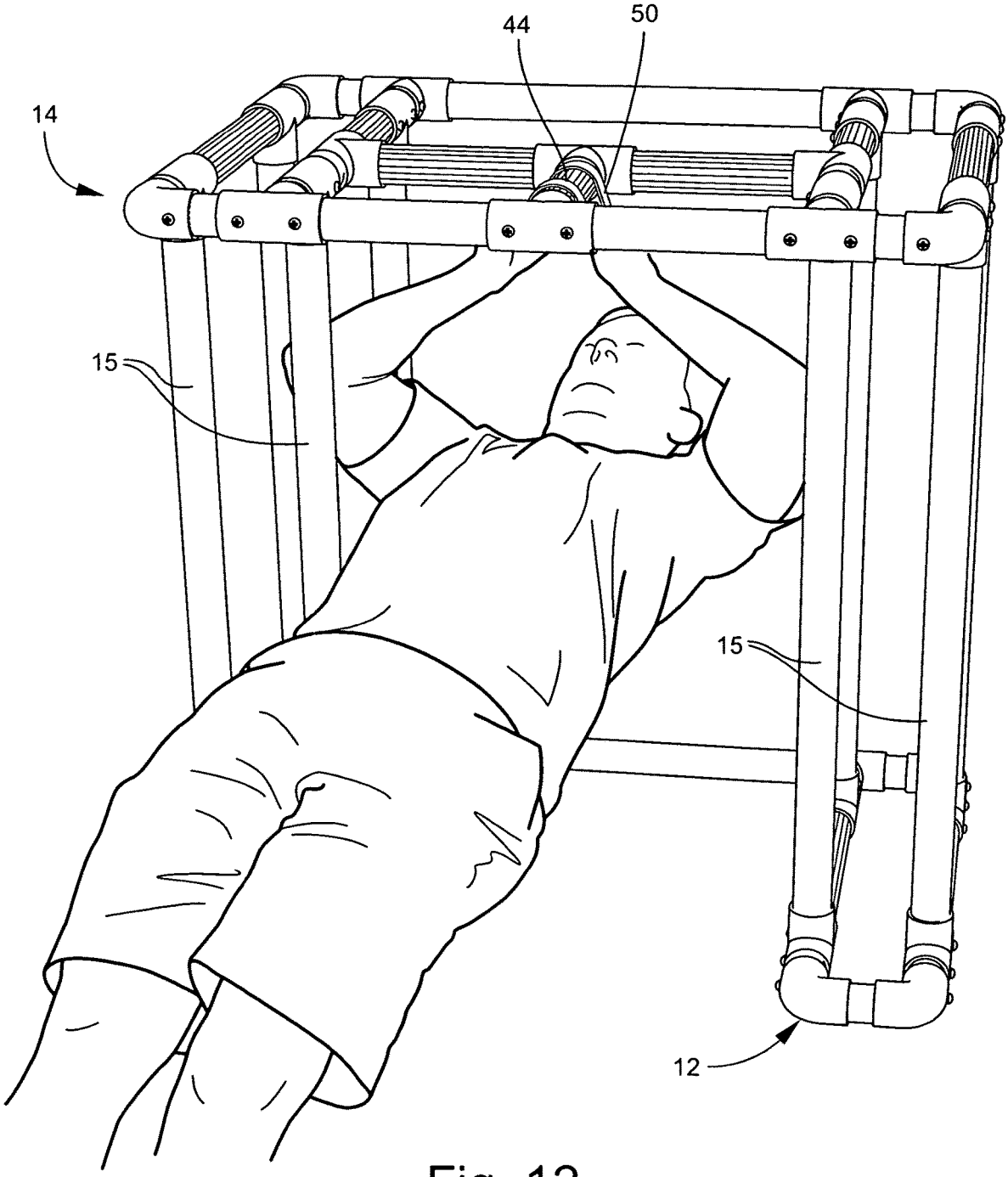
Figure 13:
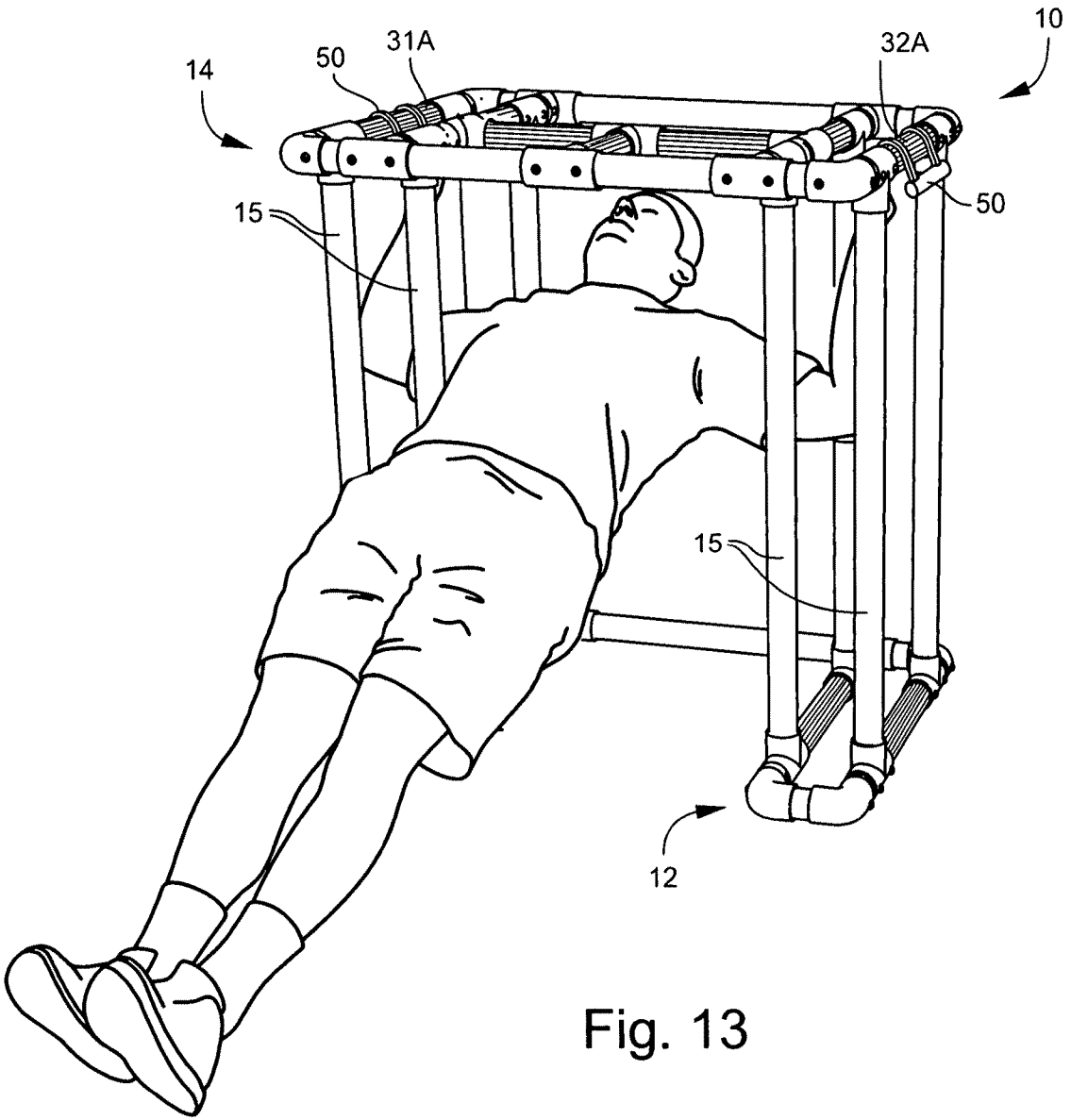

FIGS. 11, 12, and 13 illustrate various body-weight row exercises using the pull-training bar assembly 14 of the exemplary stand 10 and an independent grip handle 50. In this orientation, the push-training bar assembly 12 and vertical spacers 15 cooperate to form a base assembly for elevating the pull-training bar assembly 14 above the supporting floor. A close-grip row exercise using the exemplary grip handle 50 and fluted center bar segment 41 of the pull-training bar assembly 14 is demonstrated in FIGS. 11 and 12. The fluted center bar segment 41 may be identically colored (e.g., red, blue, green, etc.—a color distinct from the remaining bar segments of the exercise stand 10) to indicate the handle placement for this exercise. FIG. 13 demonstrates a wide-grip row exercise using two grip handles 50 and the fluted outside pull bar segments 31A, 32A The fluted segments 31A, 32A may be identically colored (e.g., red, blue, green, etc.—a color distinct from the remaining bar segments of the exercise stand 10) to indicate the handle placement for this exercise.

Figure 14:
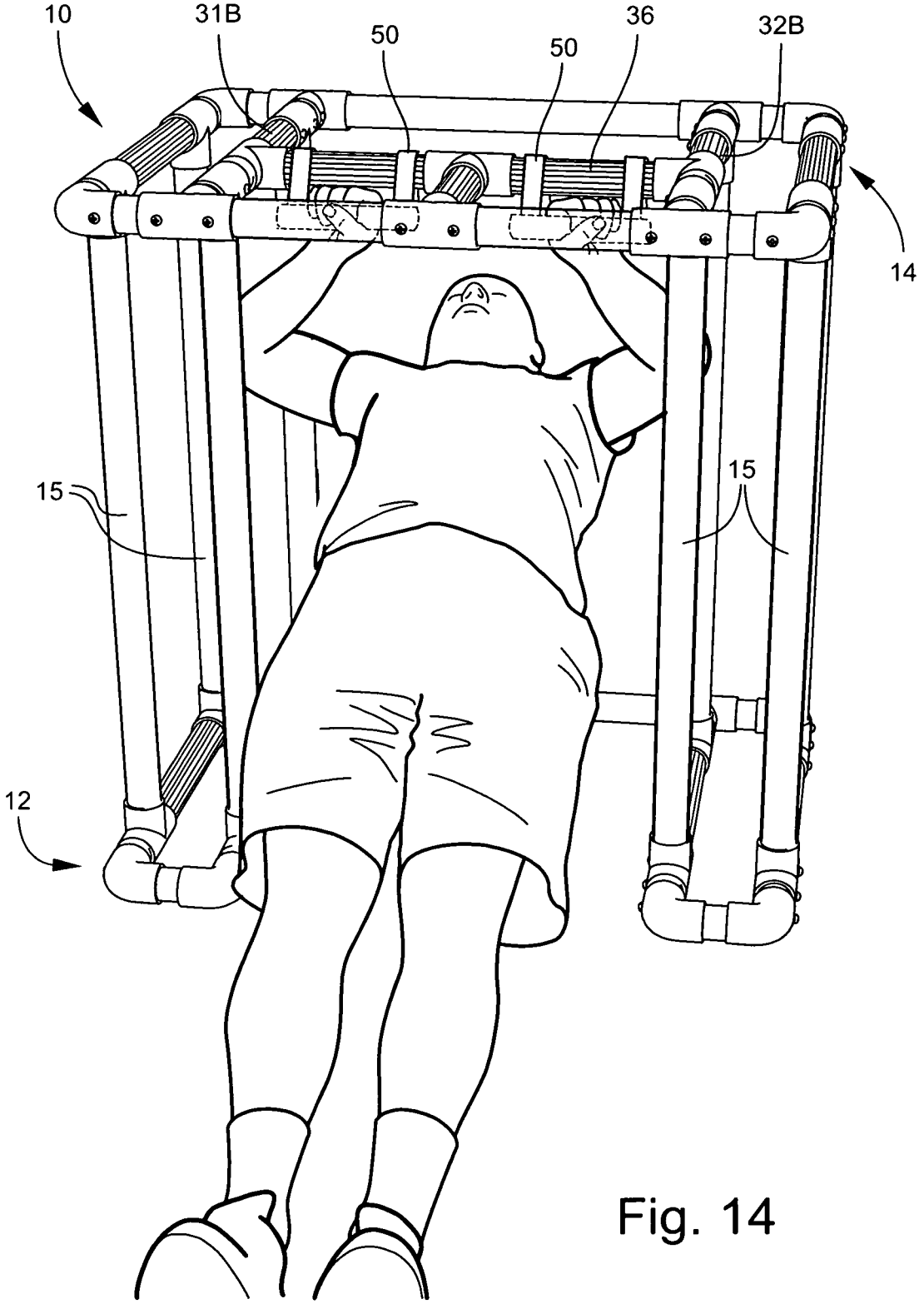

FIG. 14 demonstrates a modified pull-up exercise using the grip handles 50 applied to the intermediate fluted crossbar segment 36 of the pull-training bar assembly 14. For this exercise, the user grasps the grip handles 50—palms facing out, legs and torso straight—and lifts and lowers his body between the spaced inside pull bar segments 31B, 32B. The fluted bar segment 36 may also be colored (e.g., red, blue, green, etc.—a color distinct from the remaining bar segments of the exercise stand 10) to indicate the handle placement for this exercise.

Figure 15:
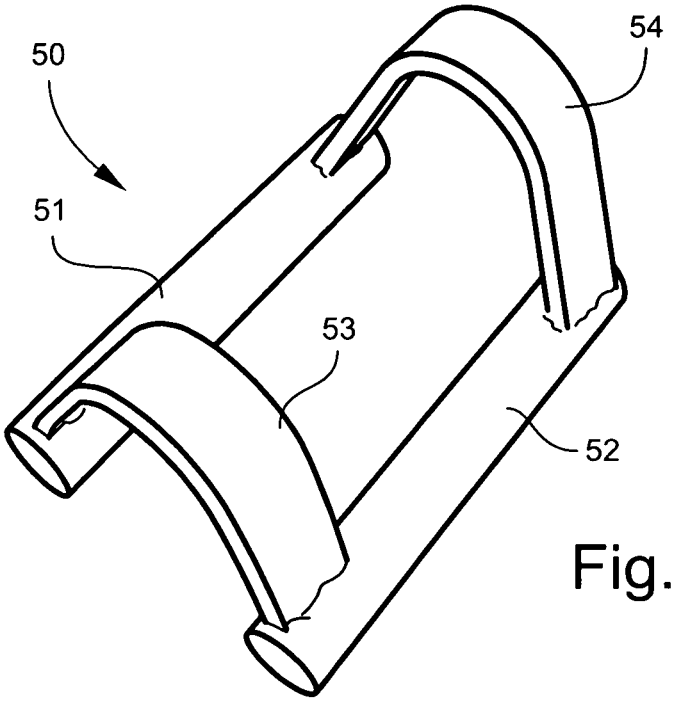
FIGS. 15, 16, and 17 are views of the exemplary grip handle applicable for use in combination with the present exercise stand.
Figure 16:
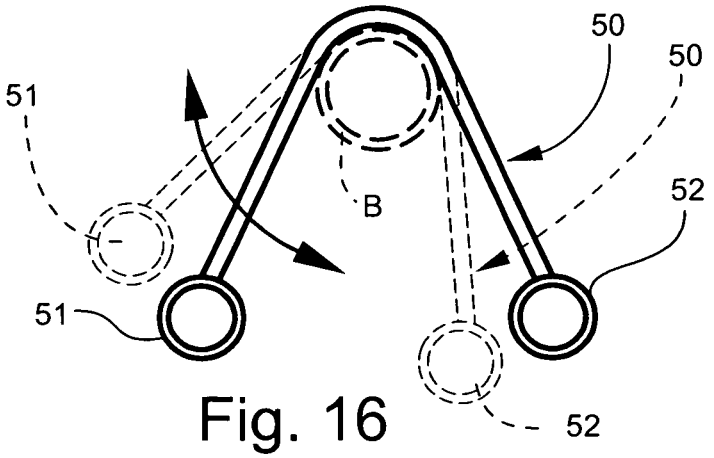
Figure 17:
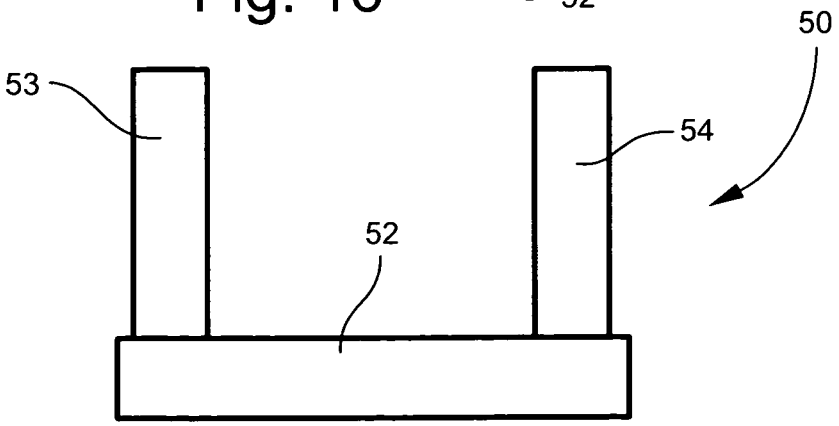

The exemplary grip handle 50, best shown in FIGS. 15, 16, and 17, comprises first and second spaced apart hand bars 51, 52 integrally joined together by spaced-apart generally V-shaped (or U-shaped) connectors 53, 54. The arcuate bend 53A, 54A at the center of each connector 53, 54 is designed to engage a single bar segment "B" of the exercise stand 10, as illustrated in FIG. 16, and permits a range of swivel movement of the handle 50 relative to the bar segment "B" during performance of the particular exercise.

Figure 18:
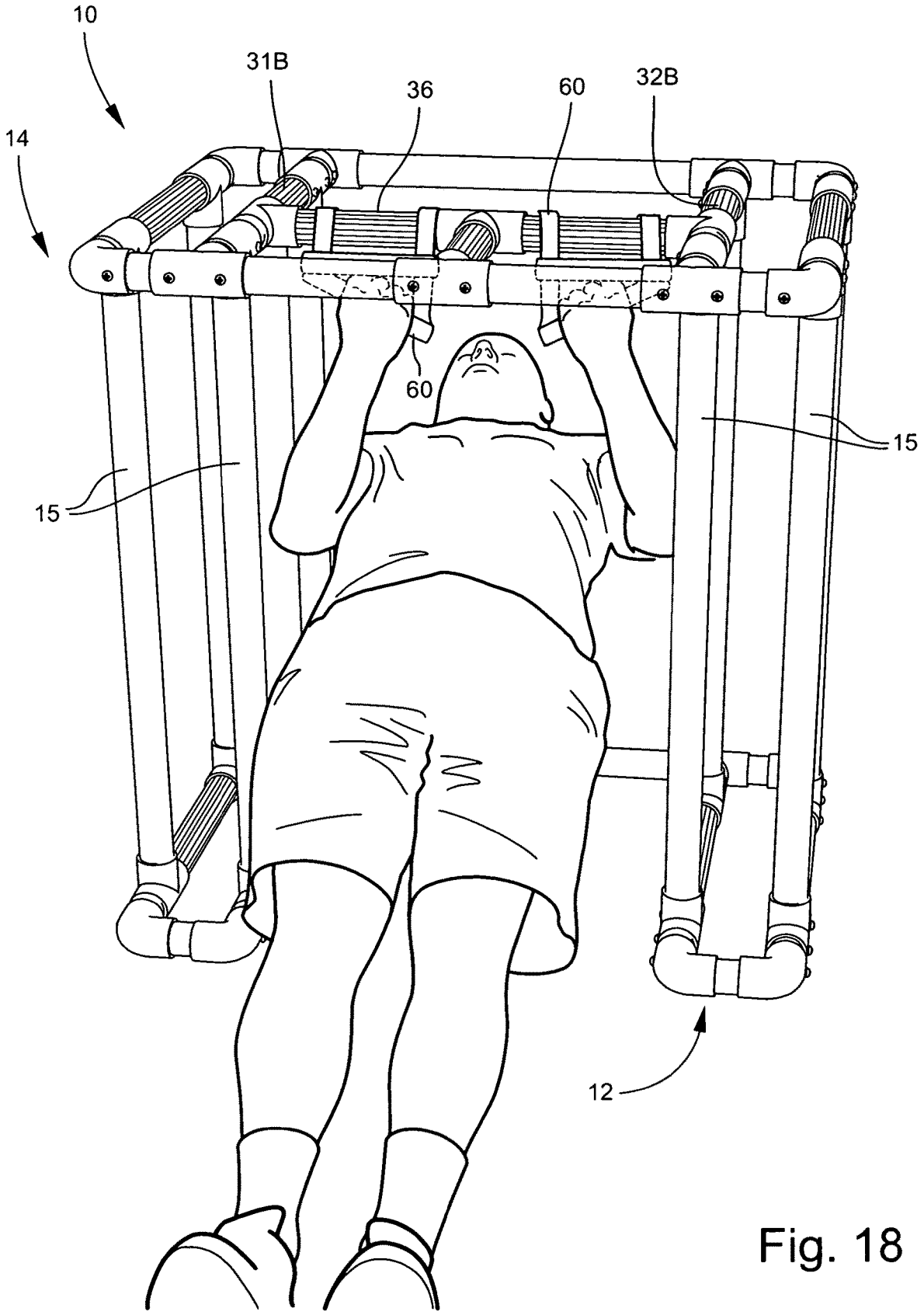
FIG. 18 shows a user demonstrating a further pull movement exercise using the exemplary stand and an alternative exemplary grip handle.

A further body-weight pull exercise (e.g., modified arm curl) using the exemplary multipurpose stand 10 is demonstrated in FIG. 18. For this exercise, with palms facing inward the user grasps an alternative grip handle 60 (FIGS. 19, 20, and 21) applied to the intermediate fluted crossbar segment 36 of the pull-training bar assembly 14, and lifts and lowers his body between the inside pull bar segments 31B, 32B. The legs and torso remain substantially straight and aligned during this exercise movement, as described above. Depending upon relative fatigue and user ability, this and other compound pull exercises may be modified by bending the knees to adjust the body weight center of gravity.

Figure 19:
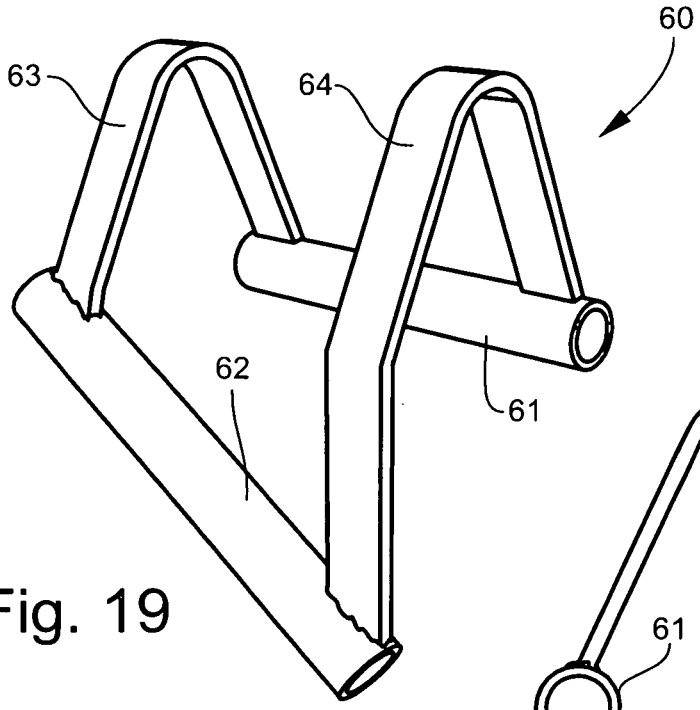
FIGS. 19, 20, and 21 are views of the alternative grip handle applicable for use in combination with the present exercise stand.
Figure 20:
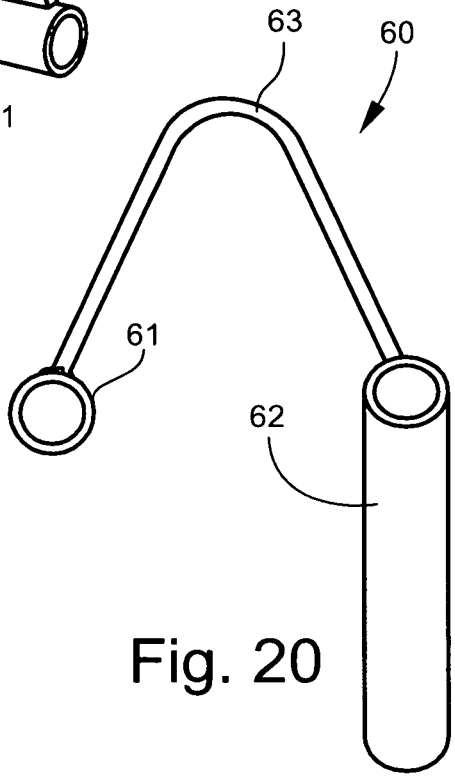
Figure 21:
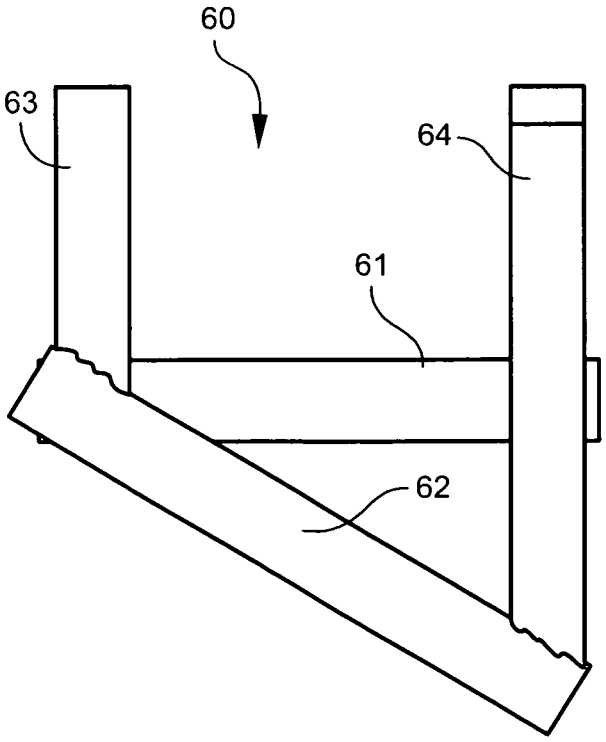

As best shown in FIGS. 19, 20, and 21, the exemplary grip handle 60 comprises spaced apart hand bars 61, 62 integrally joined together by spaced-apart generally V-shaped (or U-shaped) connectors 63, 64. As previously described, the arcuate bend 63A, 64A at the center of each connector 63, 64 is designed to engage a single bar segment of the exercise stand 10, and permits a range of swivel movement of the handle 60 relative to the bar segment. The first hand bar 61 of the grip handle 60 is generally straight, while the second hand bar 62 is angled (e.g., 45 degrees) relative to first hand bar 61. The user may perform any of the various body-weight pull exercises described herein using either the straight or angled hand bars 61, 62 of the grip handle 60.

Other Exercises

Figure 22:
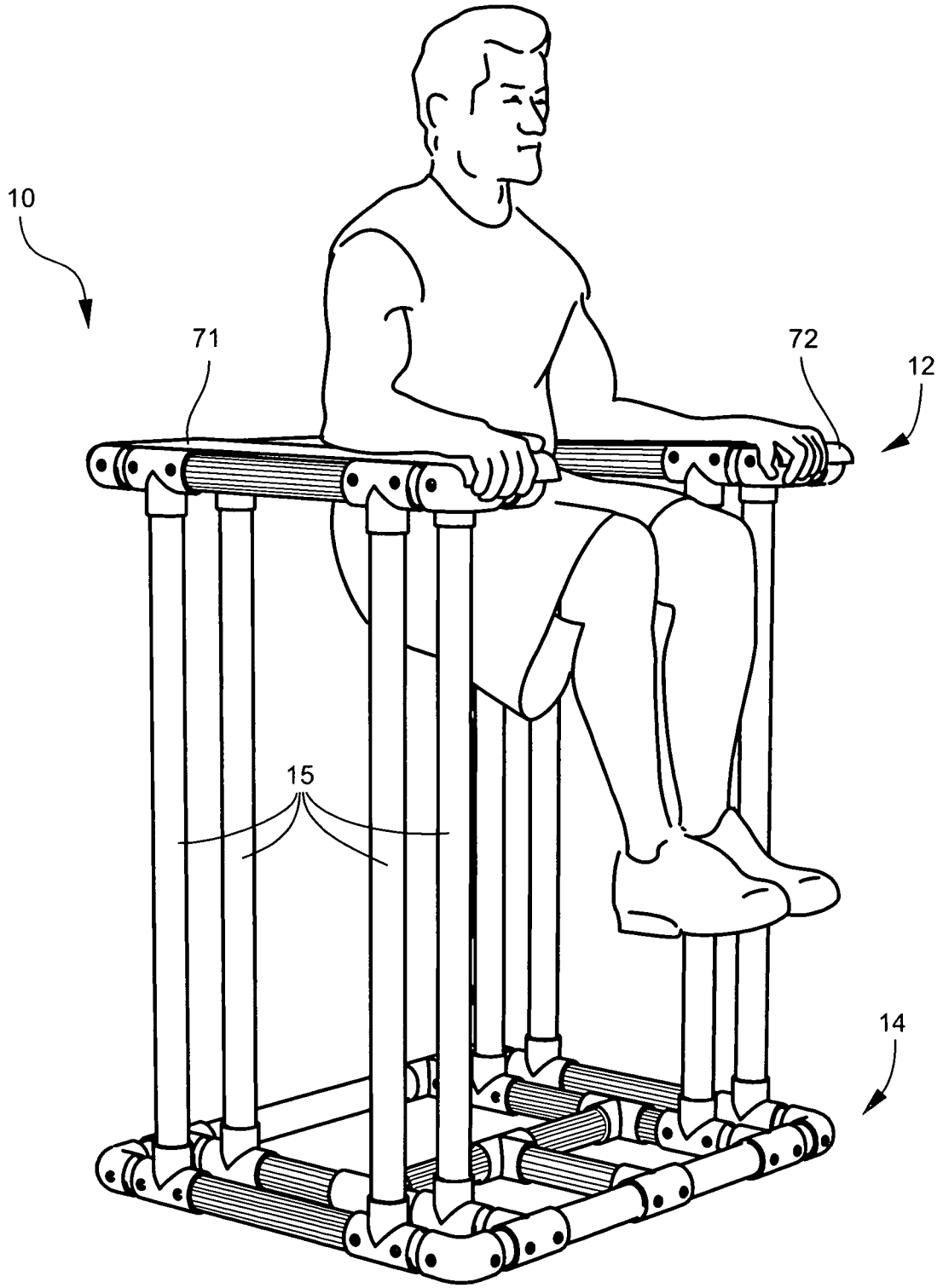
FIGS. 22 and 23 show the exemplary exercise stand used in combination with removable body-weight support covers.
Figure 23:
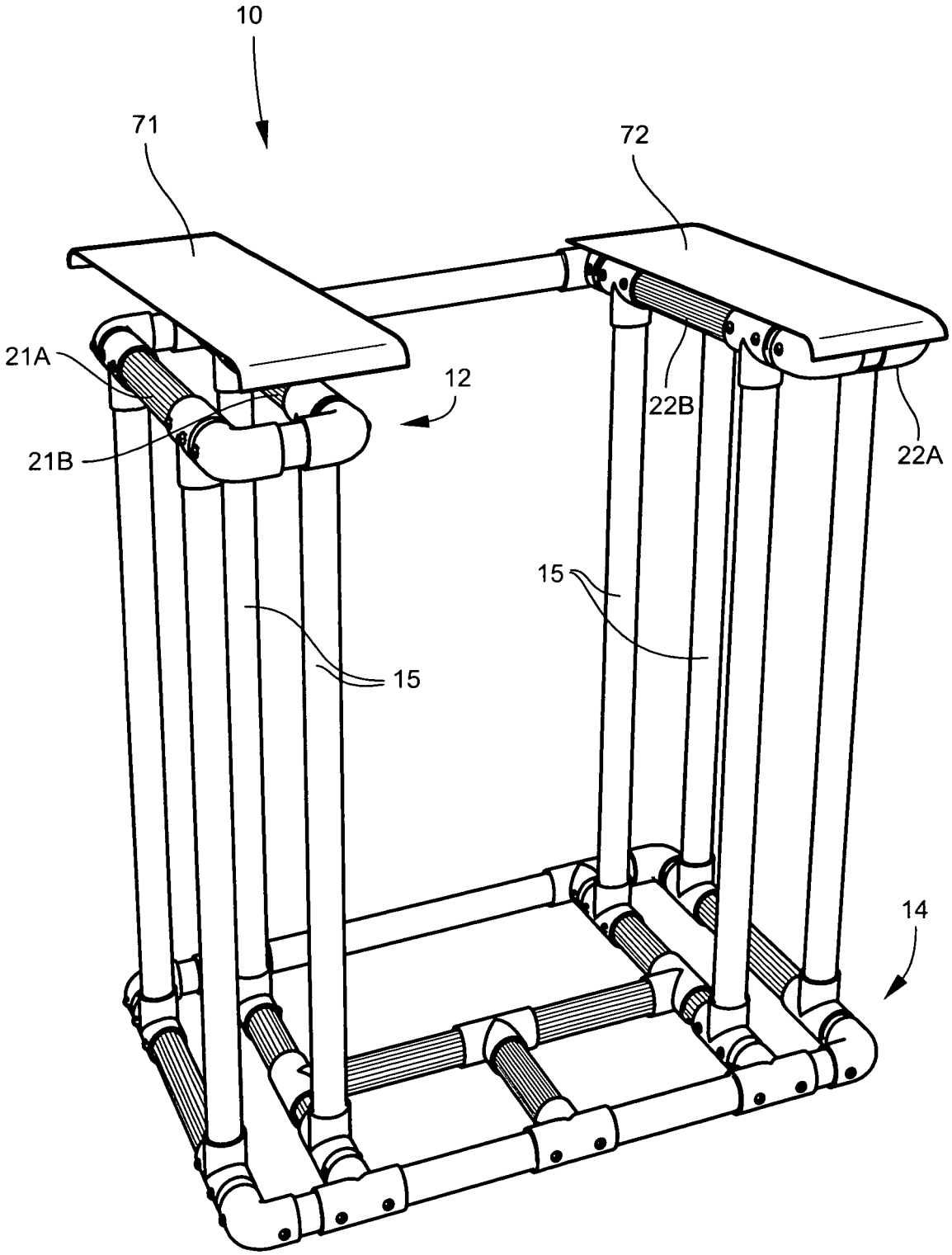

FIGS. 22-26 demonstrate additional body weight exercises using the exemplary multipurpose stand 10. In FIG. 22, the user places his forearms on removable rigid flat covers 71, 72 applied to respective pairs of inside and outside dip grip segments 21A, 22A, 21B, 22B of the push-training bar assembly 12. The covers 71, 72 are best illustrated in FIG. 23. While supporting his body weight, the user then lifts and lower his legs to exercise primarily the abdominal muscles.

Figure 24:
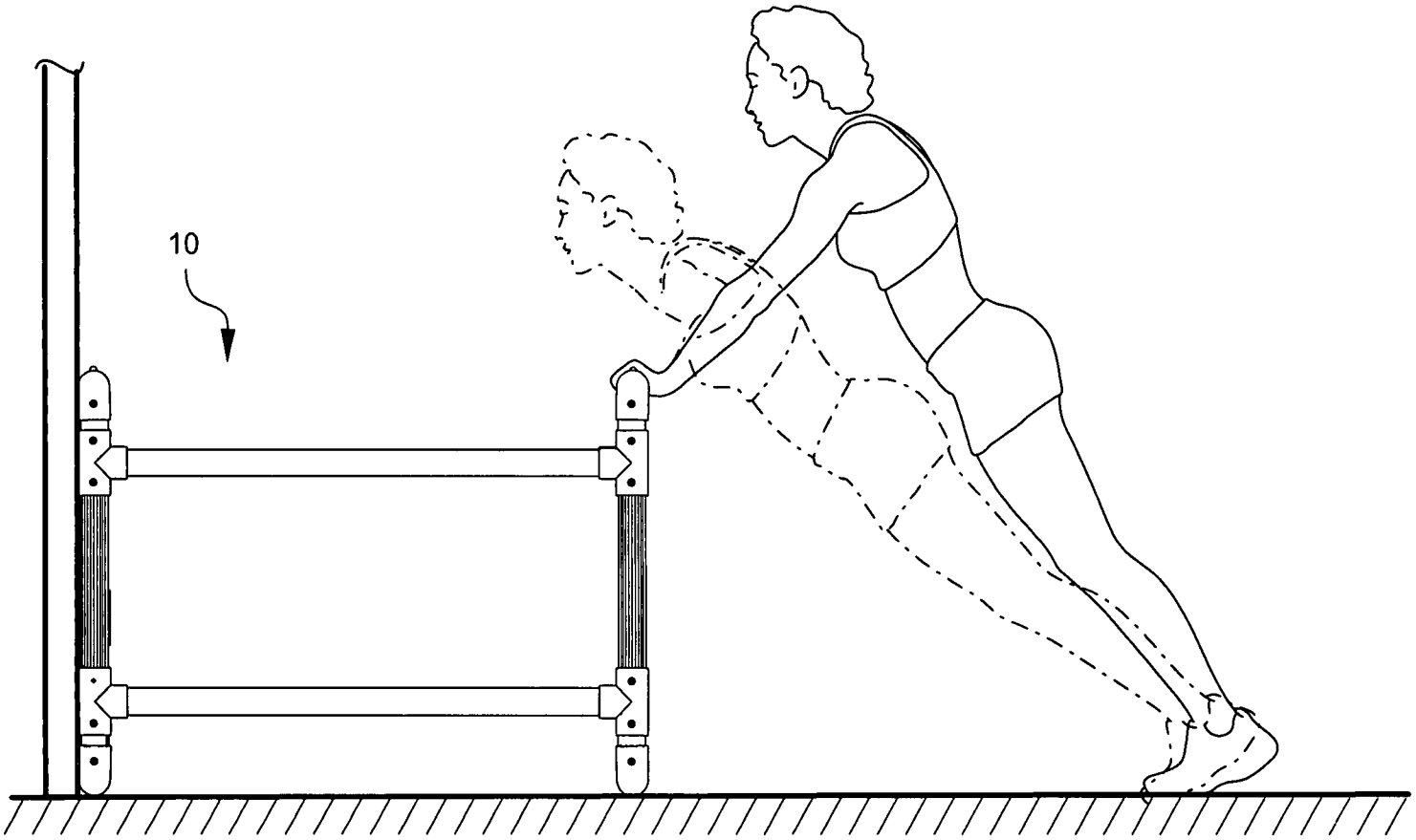
FIG. 24 shows the exemplary exercise stand laid on its side on the supporting floor and against a vertical wall for performing addition push and pull-training exercises.

FIG. 24 shows the exemplary exercise stand 10 laid on its side on the supporting floor and against a vertical wall. In this orientation, the user may perform multiple body-weight push and pull training exercises including the modified push-up demonstrated in this figure.

Figure 26:
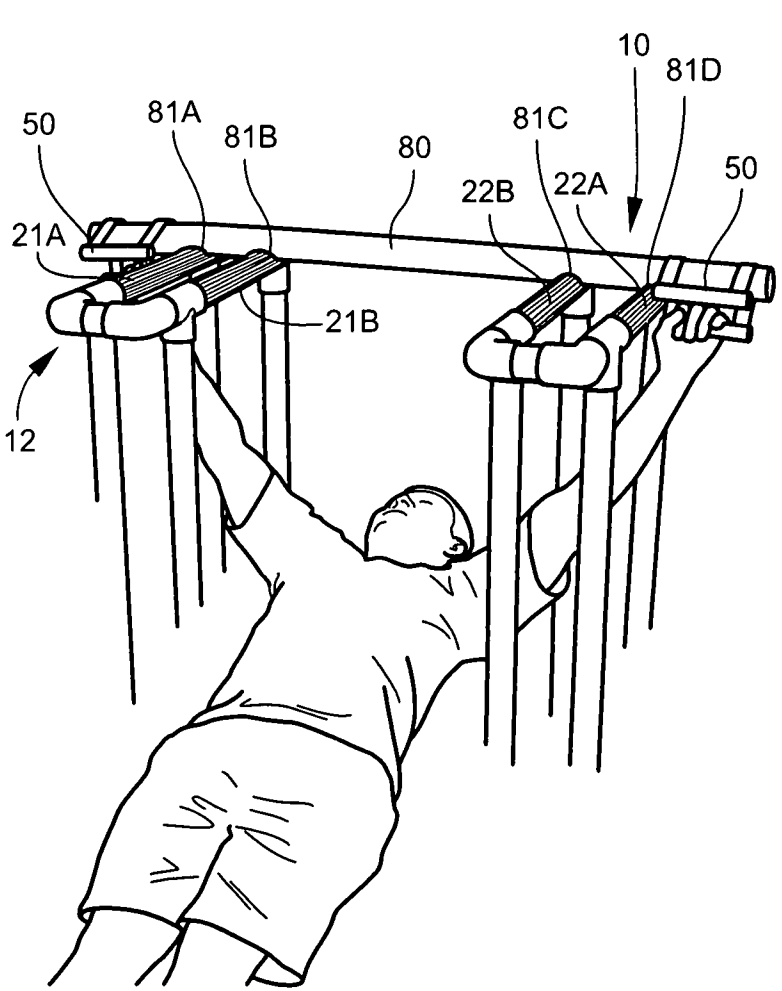
FIGS. 25 and 26 show a user demonstrating a further pull movement exercise using the push-training bar assembly of the exemplary stand.
Figure 25:
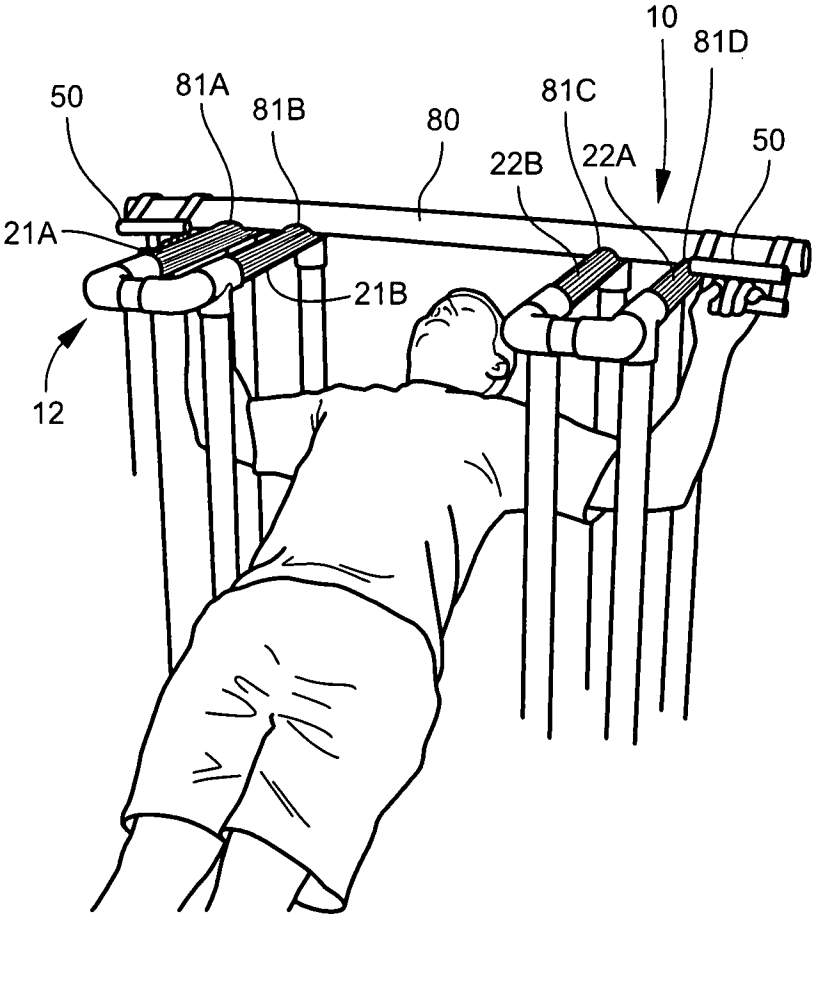

FIGS. 25 and 26 demonstrate use of the exemplary exercise stand 10 in combination with grip handles 50 previously described, and an independent rigid suspension bar 80 applied to the pairs of inside and outside dip grip segments 21A, 22A, 21B, 22B of the push-training bar assembly 12. The grip handles 50 may be located at opposite ends of the suspension bar 80 and used for a wide grip row exercise. In addition, the suspension bar 80 may have longitudinally spaced recesses 81A, 81B, 81C, 81D located to align with respective dip grip segments 21A, 22A, 21B, 22B to facilitate proper placement and retention of the bar 80 while performing the exercise.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed:

1. A multipurpose exercise stand for compound fitness training, comprising:

a horizontal push-training bar assembly comprising first and second pairs of parallel tubular inside and outside dip grip segments all residing in the same horizontal plane and all extending in a direction parallel to one another, and a crossbar segment interconnecting and perpendicularly disposed to said first and second pairs of inside and outside dip grip segments, and said first and second pairs being laterally spaced apart to accommodate body lifting and body lowering movement of a user performing a dip exercise while gripping either the two inside dip grip segments or the two outside dip grip segments;

a horizontal pull-training bar assembly longitudinally spaced from said push-training bar assembly, and comprising:

first and second pairs of inside and outside pull bar segments longitudinally aligned with said first and second pairs of inside and outside dip grip segments;

a first crossbar segment connected and perpendicularly disposed to said first and second pairs of inside and outside pull bar segments, and longitudinally aligned with the crossbar segment of said push-training bar assembly;

a second crossbar segment connected and perpendicularly disposed to said inside pull bar segments;

a third crossbar segment connected and perpendicularly disposed to said inside pull bar segments; and a center bar segment connected and perpendicularly disposed to said second crossbar segment and said third crossbar segment; and a plurality of longitudinal rigid spacer bars interconnecting said push-training bar assembly and said pull-training bar assembly.

2. The multipurpose exercise stand according to claim 1, and comprising at least one independent rigid grip handle adapted for use in combination with said stand to perform compound pull exercises.

3. The multipurpose exercise stand according to claim 2, wherein said grip handle comprises first and second spaced apart hand bars integrally joined together by at least one generally V-shaped connector.

4. The multipurpose exercise stand according to claim 3, wherein said first hand bar of said grip handle is angled relative to said second hand bar.

5. The multipurpose exercise stand according to claim 1, wherein said push-training bar assembly comprises an arrangement of rigid polymer pipes and pipe fittings.

6. The multipurpose exercise stand according to claim 1, wherein said pull-training bar assembly comprises an arrangement of rigid polymer pipes and pipe fittings.

7. The multipurpose exercise stand according to claim 1, wherein said longitudinal spacer bars comprise rigid polymer pipes.

8. The multipurpose exercise stand according to claim 1, wherein segments of said push-training bar assembly and said pull-training bar assembly are color coded for different exercises.

* * * * *